US008973589B2

(12) United States Patent
Kaljura et al.

(10) Patent No.: US 8,973,589 B2
(45) Date of Patent: Mar. 10, 2015

(54) EMBOSSING TECHNIQUES

(75) Inventors: Karl Kaljura, London (GB); Leonardo Nappi, London (GB)

(73) Assignee: British American Tobacco (Investments) Limited, London (GB)

( * ) Notice: Subject to any disclaimer, the term of this patent is extended or adjusted under 35 U.S.C. 154(b) by 123 days.

(21) Appl. No.: 13/642,441

(22) PCT Filed: Apr. 13, 2011

(86) PCT No.: PCT/EP2011/055781
§ 371 (c)(1),
(2), (4) Date: Feb. 25, 2013

(87) PCT Pub. No.: WO2011/131529
PCT Pub. Date: Oct. 27, 2011

(65) Prior Publication Data

US 2013/0139837 A1 Jun. 6, 2013

(30) Foreign Application Priority Data

Apr. 22, 2010 (GB) ..... 1006725.4

(51) Int. Cl.
*A24D 1/02* (2006.01)
*B31D 5/02* (2006.01)
(Continued)

(52) U.S. Cl.
CPC . *B31D 5/02* (2013.01); *A24C 5/005* (2013.01); *A24D 1/02* (2013.01); *B31F 1/07* (2013.01); *B31F 2201/0733* (2013.01); *B31F 2201/0735* (2013.01); *B31F 2201/0738* (2013.01); *B31F 2201/0753* (2013.01); *B31F 2201/0758* (2013.01); *B31F 2201/0779* (2013.01); *B31F 2201/0782* (2013.01)
USPC ..... 131/365; 162/139; 131/347; 101/5

(58) Field of Classification Search
USPC ..... 162/139, 109, 116, 117, 296, 300, 162/308–9, 312–314, 361, 362; 131/365; 428/156, 167; 425/385; 264/293; 101/3.1–7
See application file for complete search history.

(56) References Cited

U.S. PATENT DOCUMENTS 2,981,261 A * 4/1961 Rupert ..... 131/336
3,228,402 A * 1/1966 Lebert ..... 131/339
(Continued)

FOREIGN PATENT DOCUMENTS

EP 0 584 957 A1 3/1994
GB 0852309 A 10/1960
(Continued)

OTHER PUBLICATIONS

International Search Report and Written Opinion, mailed Aug. 16, 2011, for PCT International Application No. PCT/EP2011/055781, filed Apr. 13, 2011.
(Continued)

*Primary Examiner* — Dennis Cordray
(74) *Attorney, Agent, or Firm* — N W Poulsen; L A Pinol

(57) ABSTRACT

An embossing apparatus for applying an embossing pattern to a wrapper for a smoking article, the embossing apparatus configured so as to act to at least partially minimize the reduction, in at least one direction, in the tensile strength of the wrapper resulting from the application of said embossing pattern.

18 Claims, 6 Drawing Sheets

(51) Int. Cl.
*B31F 1/07* (2006.01)
*A24C 5/00* (2006.01)

(56) References Cited

U.S. PATENT DOCUMENTS

| | | | | |
|---|---|---|---|---|
| 5,356,506 | A * | 10/1994 | McNeil et al. | 156/553 |
| 5,464,028 | A * | 11/1995 | Takeda et al. | 131/336 |
| 5,468,323 | A * | 11/1995 | McNeil | 156/209 |
| 5,518,801 | A * | 5/1996 | Chappell et al. | 428/152 |
| 6,019,106 | A | 2/2000 | Okusawa | |
| 6,457,475 | B1 * | 10/2002 | Tani et al. | 131/365 |
| 7,145,054 | B2 * | 12/2006 | Zander et al. | 604/380 |
| 8,603,277 | B2 * | 12/2013 | Paldey et al. | 156/209 |
| 2004/0094004 | A1 * | 5/2004 | Julius | 83/39 |
| 2005/0178508 | A1 | 8/2005 | Steuer | |
| 2009/0312738 | A1 * | 12/2009 | LaVon et al. | 604/385.28 |
| 2010/0028621 | A1 * | 2/2010 | Byrne et al. | 428/195.1 |

FOREIGN PATENT DOCUMENTS

| | | | |
|---|---|---|---|
| GB | 0875252 | A | 8/1961 |
| GB | 1439705 | | 6/1976 |
| GB | 1524211 | A1 | 9/1978 |
| WO | WO2009/141217 | A1 | 11/2009 |

OTHER PUBLICATIONS

International Preliminary Report on Patentability, mailed Jul. 19, 2012, for PCT International Application No. PCT/EP2011/055781, filed Apr. 13, 2011.

Written Opinion of the International Preliminary Examining Authority, mailed Mar. 19, 2012, for PCT International Application No. PCT/EP2011/055781, filed Apr. 13, 2011.

United Kingdom Intellectual Property Office Search Report, dated Aug. 18, 2010, for GB1006725.4.

* cited by examiner

EMBOSSING TECHNIQUES

CLAIM FOR PRIORITY

This application is a National Stage Entry entitled to and hereby claims priority under 35 U.S.C. §§365 and 371 to corresponding PCT Application No. PCT/EP2011/055781, filed Apr. 13, 2011, which in turn claims priority to GB Application No. 1006725.4, filed Apr. 22, 2010. The entire contents of the aforementioned applications are herein expressly incorporated by reference.

FIELD OF THE INVENTION

This invention relates to improvements in embossing techniques. In particular, the invention relates to embossing techniques for smoking articles.

BACKGROUND TO THE INVENTION

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products.

Conventional filtered cigarettes generally comprise a rod of tobacco wrapped in a cigarette paper and a filter plug wrapped in a plug wrap. The filter plug and tobacco rod are connected using a tipping paper. The amount of smoke drawn through the filter depends on various factors, for example the air permeability of the cigarette paper, plug wrap and/or tipping paper. For instance, a cigarette paper of a high air permeability will permit airflow through the cigarette paper and will dilute the smoke more than a cigarette paper of lower air permeability. The air permeability of the cigarette paper used in cigarette manufacture is therefore a factor in controlling, at least, the smoke dilution of the cigarette.

One method of modifying the air permeability of paper is through an embossing process, as discussed, for example, in GB 1524211. The embossing process generally comprises exerting pressure at localised areas on the surface of the paper in order to open or stretch the fibrous structure of the paper to create indentations or holes in the paper. This has the effect of modifying the air permeability of the paper. Controlling the embossing process provides a means for controlling the air permeability of the paper.

Disadvantageously, the embossing process can cause a reduction in the tensile strength of the paper. This reduction in tensile strength can result in papers such as cigarette papers, plug wraps and tipping papers tearing as the paper is put under stress and/or strain during the cigarette and/or filter manufacturing process. This is undesirable and has the effect of limiting the rate of production.

SUMMARY OF THE INVENTION

According to one aspect of the present invention there is provided an embossing apparatus for applying an embossing pattern to a wrapper for a smoking article, the embossing apparatus configured so as to act to at least partially minimise the reduction, in at least one direction, in the tensile strength of the wrapper resulting from the application of said embossing pattern. In this sense, partially minimised may be taken to mean that the reduction in tensile strength caused by embossing the wrapper may be offset though configuration of the embossing apparatus for that purpose.

Advantageously, minimising the degree to which tensile strength is reduced by the embossing process may avoid or mitigate some of the problems associated with reduced tensile strength. In particular, improving the tensile strength of the wrapper in this manner may mitigate the problem of tearing of the wrapper, which can reduce production.

Typically, the embossing pattern is applied so as to increase the diffusivity and/or permeability of said wrapper and wherein the embossing pattern is selected such that for a given increase in diffusivity and/or permeability, the embossing pattern minimises an embossing stress and/or strain placed on the wrapper, during application of the embossing pattern, in at least one direction.

Variations in the stress and/or strain on the wrapper can alter the effects of the embossing process. For example, deeper embossing, by applying a greater embossing force, can cause larger holes/indentations which affect the diffusivity and/or permeability of the wrapper. It is a further advantage of the present invention that a desired amount of diffusivity and/or permeability may be better controlled, having better consistency, by selecting an embossing pattern which minimises the embossing stress and/or strain placed on the paper.

Preferably, application of the embossing pattern is arranged to result in an embossed wrapper having different strength characteristics in different directions.

Preferably, the embossing apparatus comprises an embossing roller for applying the embossing to the wrapper; and means for maintaining the embossing roller at a predetermined distance from said wrapper so as to limit the depth of the embossing. Advantageously, maintaining the predetermined distance is one method for minimising the stress placed on the wrapper as the embossing roller applies the embossing pattern to the wrapper.

In a preferred embodiment, the embossing apparatus comprises at least two embossing rollers for applying the embossing to the wrapper running in a longitudinal direction between the at least two rollers, wherein the maintaining means maintains a minimum distance between circumferential surfaces of the at least two embossing rollers.

According to another aspect of the present invention there is provided an embossed wrapper for a smoking article, wherein the embossing is applied in a pattern selected such that for a given increase in diffusivity and/or permeability resulting from the embossing, the embossed pattern acts to at least partially minimise the reduction, in at least one direction, in the tensile strength of the wrapper resulting from the application of said embossing.

Preferably, the embossed pattern is selected to minimise weakness lines running through an embossed region of the wrapper, in a least one direction. Weakness lines are introduced during the embossing process as the fibrous structure of the wrapper material, typically cigarette paper, is opened and stretched. It is an advantage of selecting an appropriate embossed pattern that the extent to which the weakness lines cause a reduction in tensile strength can be minimised.

Preferably, the embossed pattern comprises an embossed region and a non-embossed region, and a leading edge between the embossed region and the non-embossed region, the leading edge being arranged to be non-perpendicular to a longitudinal direction of the wrapper.

Optionally, the embossed pattern comprises a spiral or helical pattern when the wrapper is wrapped around the smoking article. This arrangement of embossing pattern has further advantages in that the spiral or helical pattern is a mechanism for encouraging the smoking article to self-extinguish in the absence of being drawn. This is a particularly an advantage in relation to Low Ignition Propensity smoking articles.

In a preferred embodiment, the embossed pattern of the wrapper comprises indentations which have no substantially perpendicular edges with respect to a longitudinal direction of the wrapper. Optionally, the embossed pattern of the wrapper comprises indentations of rhomboidal shape which have no substantially perpendicular edges with respect to a longitudinal direction of the wrapper. In one optional embodiment, the embossed pattern is formed from an array of indentations in which transversally adjacent indentations are longitudinally offset from each other.

According to another aspect of the present invention, there is provided an embossing roller for applying an embossing pattern to a wrapper for a smoking article, wherein the embossing roller comprises a plurality of embossing protrusions arranged such that for a given increase in diffusivity and/or permeability of a wrapper embossed using said roller, the embossed protrusions act to at least partially minimise the reduction, in at least one direction, in the tensile strength of the wrapper resulting from the application of said embossing.

Preferably, the embossing protrusions are arranged such that applying the embossing roller to the wrapper results in a wrapper as described above.

The above embossing patterns advantageously reduce the strain and/or stress placed on the wrapper when the wrapper and/or smoking article is being manufactured.

According to another aspect of the present invention, there is provided a method of embossing a wrapper for a smoking article, the method comprising applying an embossing pattern to the wrapper so as to act to at least partially minimise the reduction, in at least one direction, in the tensile strength of the wrapper resulting from the application of said embossing pattern.

In a preferred embodiment the applying step comprises applying an embossing roller to the wrapper, the method further comprising maintaining the embossing roller at a predetermined distance from said wrapper so as to limit the depth of the embossing.

Preferably, running a web of wrapper material, in a longitudinal direction, through at least two embossing rollers, and the maintaining step comprises using a coaxial cammed movement limiter and a mechanical stop to prevent radial movement of at least one of the rollers in at least one direction.

BRIEF DESCRIPTION OF THE FIGURES

Embodiments of the invention will now be described by way of example with reference to accompanying figures, in which.

DETAILED DESCRIPTION OF THE EMBODIMENTS

Figure 1:
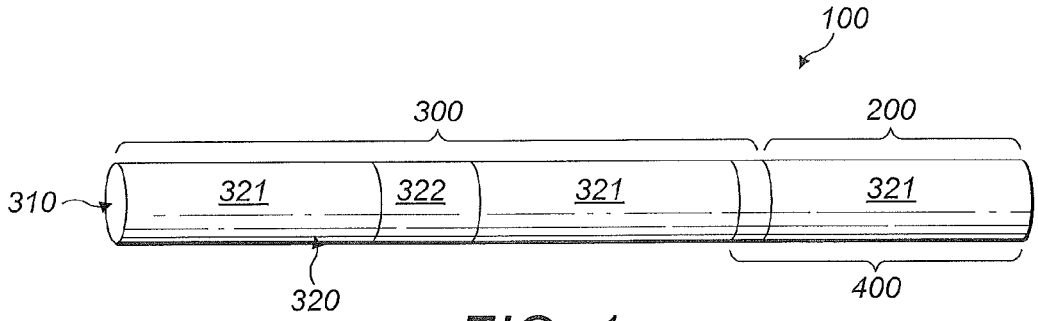
FIG. 1 is a perspective illustration of a smoking article having a paper wrapper with an embossed region and a non-embossed region.

A smoking article 100 is shown in FIG. 1. The smoking article 100 is discussed below in the context of a cigarette 100 comprising a substantially cylindrical cellulose acetate filter 200 and an axially aligned substantially cylindrical smokable material rod 300 connected to the filter 200 by a sheet of overlying tipping paper 400. However, the invention is not confined to cigarettes. It is applicable to other types of smoking article, including those referred to above.

Typically, the smokable material rod 300 comprises a substantially cylindrical core of tobacco material 310 wrapped in a wrapper 320. The wrapper 320 provides a circumferential boundary for the cylindrical core 310, as is shown in FIG. 1, with the end faces of the core 310 being left open in a conventional manner. The wrapper 320 comprises a base paper such as a cigarette paper.

The permeability of the wrapper 320 may be inherently low so as to substantially limit the permeation of external air through the wrapper 320 into the burning tobacco core 310. One reason for restricting the flow of external air to the burning tobacco core may be to cause or encourage the cigarette to self-extinguish if it is not regularly drawn upon by the smoker. Smoking articles displaying this characteristic are often referred to as Low Ignition Propensity (LIP) smoking articles. National regulation often requires that low ignition propensity smoking articles exhibit full length burn percentages of less than a particular threshold, for example 25% of the tobacco rod, when tested in accordance with ASTM E2187-04 or ASTM E2187-09, which are standards against which the ignition propensity properties of smoking articles can be assessed. In one embodiment, the permeability of the wrapper 320 may be less than 30 Coresta and preferably is less than 20 Coresta. This provides the cigarette 100 with a low ignition propensity to meet industry standards defined by ASTM E2187-04 and ASTM E2187-09.

The properties of the wrapper 320 can be improved by forming an embossed region 321 in the wrapper 320, as shown in FIG. 1. The remaining area of the wrapper is left non-embossed, and therefore constitutes a non-embossed region 322.

The embossed region 321 of the wrapper 320 has a higher air permeability than the non-embossed region 322. This allows a greater amount of external air to pass through the embossed region 321 of the wrapper 320 into the tobacco core 310, thereby increasing smoke dilution during puffing. As such, the permeability of the embossed region 321 will differ from that of the non-embossed region 322. Selection of the required permeability value of the embossed region may be made in dependence on factors including the permeability of the non-embossed region 322 and the relative area of the embossed region 321.

In addition to having higher air permeability, the embossed region 321 of the wrapper 320 also has significantly higher gas diffusivity than the non-embossed region 322. For example the gas diffusivity of the embossed region 321 may be at least five, preferably six or seven times greater than the gas diffusivity of the non-embossed region 322. The higher gas diffusivity of the embossed region 321 of the wrapper 320 allows smoke components such as CO and nitrogen oxide to diffuse out of the burning tobacco rod 300 through the embossed region 321 of the wrapper 320. As such, smoke components which would otherwise be drawn into the filter 200 during puffing are diffused out of the cigarette before reaching the filter 300 due to the higher gas diffusivity of the embossed region 321. Furthermore, the additional oxygen diffusing through the cigarette paper toward the burning tobacco due to the higher diffusivity of the embossed region 321 increases the burn rate and, therefore, reduces the puff number of the cigarette 100.

The combination of the embossed region 321 and the non-embossed region 322 provides a cigarette 100 which may conform to recognized LIP standards as above, and which provides a smoking experience arranged to have a particular puff number. While this is one reason for manufacturing a cigarette paper having an embossed region 321 and non-embossed region 322, a person skilled in the art will appreciate that there may be other reasons, and that the present invention relates generally to embossing processes irrespective of the application for the embossed material.

Figure 2:
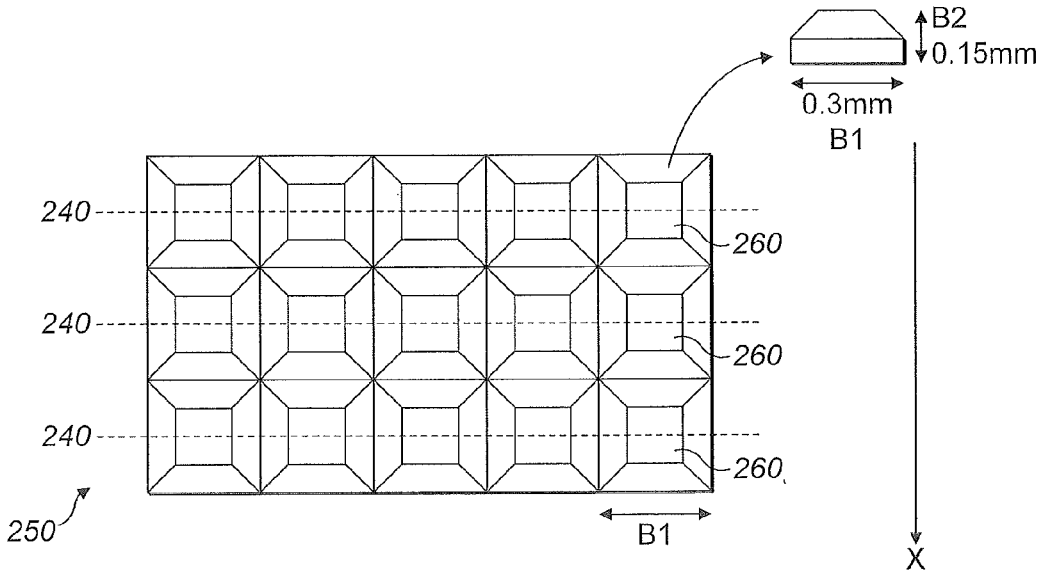
FIG. 2 is an enlarged view of a section of a wrapper having an embossed pattern for an example arrangement/formation of embossing protrusions.

As described above, the embossing process can cause a reduction in the tensile strength of the wrapper because creating indentations or holes results in lines of weakness 240 through the embossed region, as shown in FIG. 2. The lines of weakness 240, running through the centre of the rows on indentations are, in the illustrated example, perpendicular to the longitudinal direction of the paper, shown by arrow X. These lines of weakness 240 occur as a result of the stretching of the paper, in the longitudinal direction X, while the embossing pattern is being formed, in particular as a result of the stretching caused by each indentation. These lines of weakness 240, though the wrapper, reduce the tensile strength and this can cause ripping during the cigarette manufacturing process.

In addition, as described above, the wrapper 320 may have embossed and non-embossed regions, 321 and 322, meaning that at least once as the wrapper 320 is being embossed there will be a change from a non-embossed region 322 to an embossed region 321. This change corresponds to a leading edge or leading row 250 of the embossing pattern on the embossing roller 510. As described in greater detail below, in relation to the embossing apparatus and process, a significant line of weakness may be caused at the leading edge/row of the embossing pattern.

Figure 3:
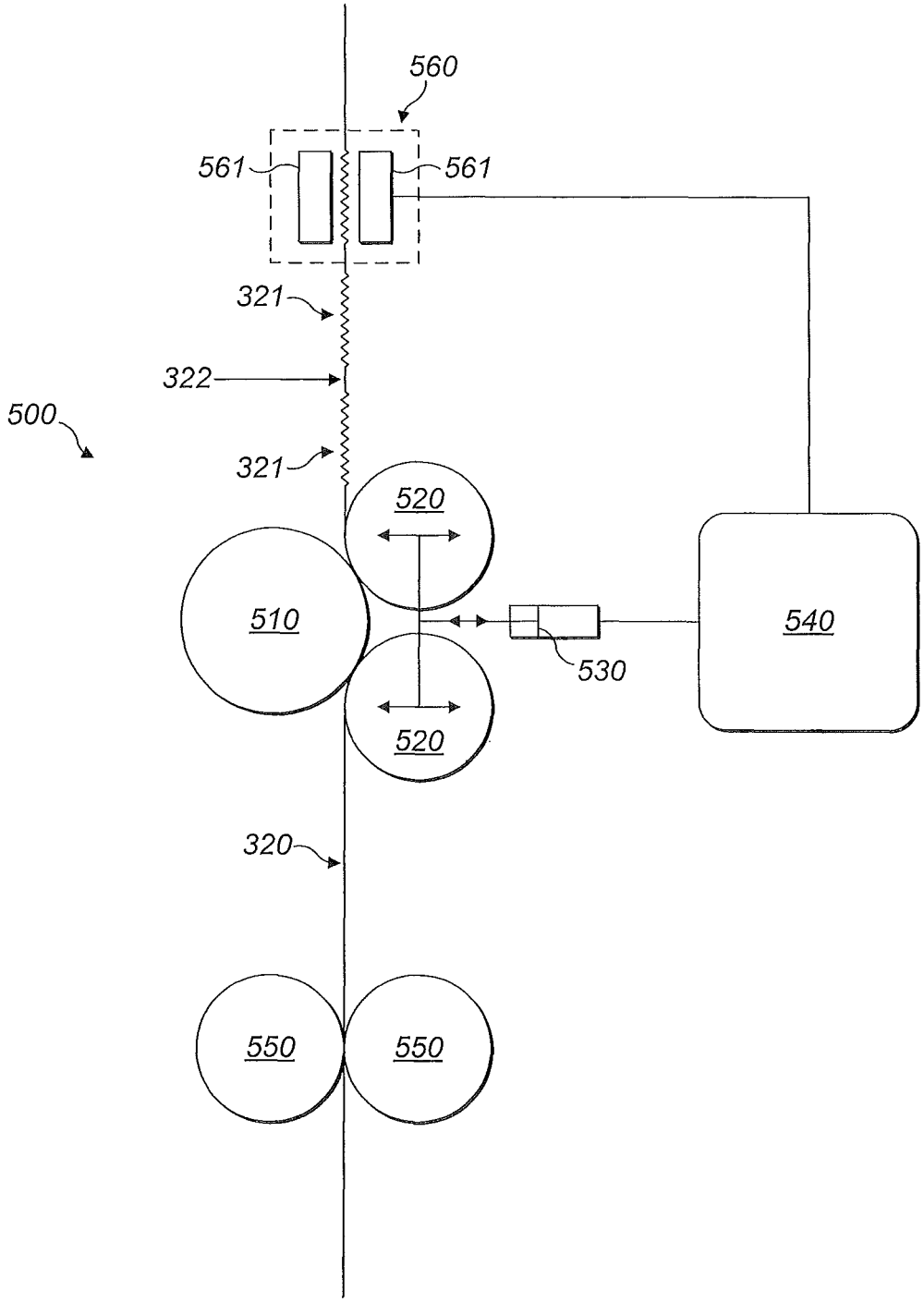
FIG. 3 is a schematic illustration of an embossing unit for manufacturing an embossed wrapper.

An example embossing unit 500 is schematically illustrated in FIG. 3. The embossing unit 500 comprises an embossing drive roller 510 and one or more embossing contrast rollers 520, which together emboss a web of base paper 320 as the paper web 320 moves between the embossing drive roller 510 and the embossing contrast roller(s) 520. In this example, the width of the web of paper is approximately 26.5 mm, which is sufficient to wrap around the circumference of the tobacco rod 300 and provide a lap seam 330 for gluing the wrapper 320 in place around the rod 300. The embossing rollers 510, 520 comprise an embossing pattern on their circumferential surface. The embossing pattern may comprise a plurality of embossing protrusions 260. In one embodiment the embossing protrusions 260 comprise a plurality of protruding pyramids with a base width B1 of approximately 0.3 mm and a height B2 of approximately 0.15 mm, as shown in FIG. 2, which are arranged in rows.

The circumferential surface of the embossing contrast roller(s) 520 are forced against the circumferential surface of the embossing drive roller 510. In one embodiment, the force may be applied by a pneumatic system comprising a piston 530. In an alternative embodiment, the embossing unit 500 may use a set of cams to control the relative positions of the embossing contrast rollers 520. The force exerted on the paper web 320 between the embossing rollers 510, 520 is proportional to the air pressure exerted against the piston 530 in the pneumatic system. The air pressure on the piston 530 can be varied by a control unit 540 which is configured to increase or decrease the air pressure in the pneumatic system according to a set of control parameters, which may be predetermined or may be adaptively determined according to the results of the embossing process. In one embodiment, the diameter of the piston 530 is approximately 2.75 inches. However, in an alternative setup, the diameter of the piston 530 may be reduced to provide greater control over the embossing force applied to the paper 320 by the embossing rollers 510, 520. The use of a smaller diameter piston 530 will result in a smaller increase in embossing force for a given increase in air pressure applied to the piston 530. A corresponding effect will be provided for decreases in air pressure. A suitable alternative diameter for the piston 530 may be approximately 1 inch.

The embossing unit 500 may also comprise one or more drive rollers 550 configured to drive the paper web 320 through the embossing unit 500, in addition to drive provided to the embossing drive roller 510. In FIG. 3, a pair of such drive rollers 550 is provided in the paper path preceding the embossing rollers 510, 520. In alternative examples, drive rollers 550 may be provided at other points in the paper web path, in addition to or in place of those illustrated in FIG. 3.

The embossing unit 500 further comprises an analysis unit 560 which is configured to analyse the properties of the paper web 320 after it has passed between the embossing rollers 510, 520. The analysis unit 560 comprises one or more sensors 561 for collecting information about the structure of the embossed paper 320. The collected information may, for example, include one or more of the air permeability of the paper 320 in the embossed 321 and non-embossed regions 322, the thickness of the paper 320 in the embossed 321 and non-embossed regions 322 and the transmission of the paper 320 in the embossed 321 and non-embossed regions 322.

As shown in FIG. 3, the analysis unit 560 is communicatively coupled to the control unit 540 to allow control signals to pass between the analysis unit 560 and the control unit 540. This communication may take place by any known means, for example via a wireless communication link. In this way, the control unit 540 may receive information from the analysis unit 560 regarding the properties of the embossed paper 320 and may use the information to adjust the force being exerted against the paper 320 by the embossing rollers 510, 520. The feedback mechanism provided by the above-described communication between the analysis unit 560 and the control unit 540 allows the embossing unit 500 to maintain embossing according to the control parameters being used. For example, the feedback mechanism may be used to maintain a particular value of air permeability in the embossed paper 320.

The air permeability and gas diffusivity of the embossed region 321 of the paper 320 can be selected by varying the force applied to the paper 320 during the embossing process.

As such, the force applied to the paper web 320 as it passes between the embossing rollers 510, 520 can be varied in dependence of the exact properties which are desired for the wrapper 320. An example embossing force applied to the wrapper 320 by the embossing rollers 510, 520 is in the range of between 2 Kgf and 55 Kgf. The precise embossing forces will depend partly on parameters such as the thickness and inherent air permeability of the wrapper 320 being used.

In addition, the air permeability and gas diffusivity of the embossed region 321 of the paper 320 can be selected by varying the size and number of the embossing protrusions 260 as well as varying the coverage area of the embossing protrusions 260.

Figure 4:
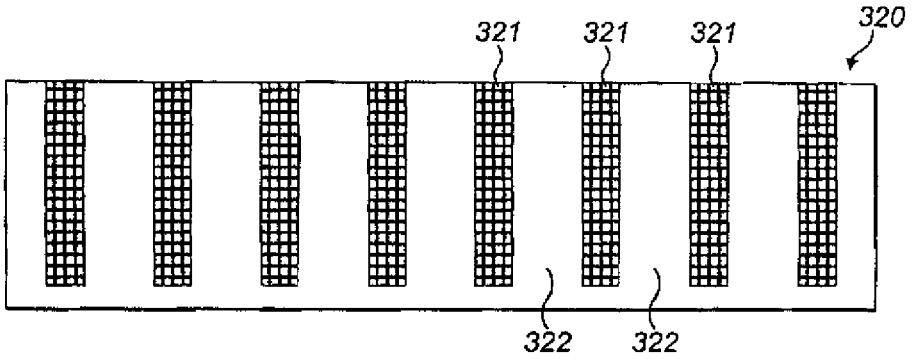
FIG. 4 is an illustration of a wrapper having a plurality of embossed and non-embossed regions in a banded formation.

As described above, the embossing process reduces the tensile strength of the paper 320. Configuring a wrapper 320 to have embossed 321 and non-embossed 322 regions can add to this problem because applying an embossing drive roller 510 having embossed and non-embossed regions to the paper web 320 results in a variation in the pressure which is applied to the paper web 320. This is particularly a problem for embossing wrappers 320 with bands or other patterns which extend transversally across the wrapper 320, as shown in FIG. 4.

Figure 5A:
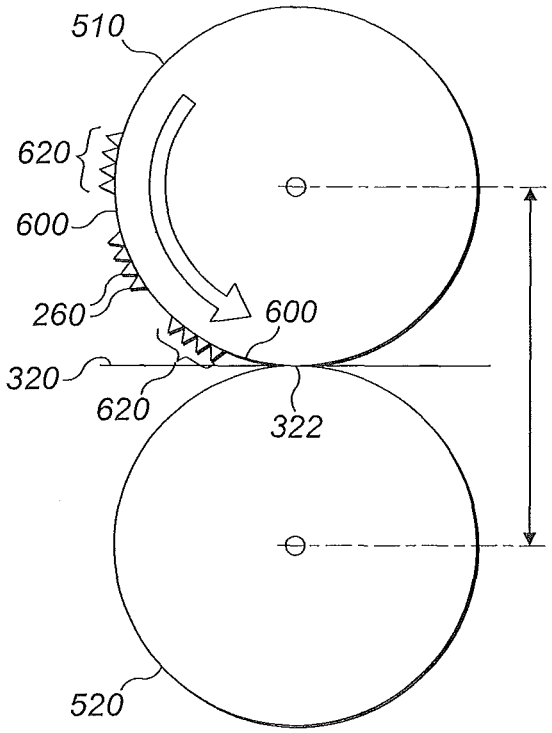
FIG. 5*a* is a front elevation of an embossing drive roller and a contrast roller showing a non-embossed region of the embossing drive roller in communication with the contrast roller.
Figure 5A:
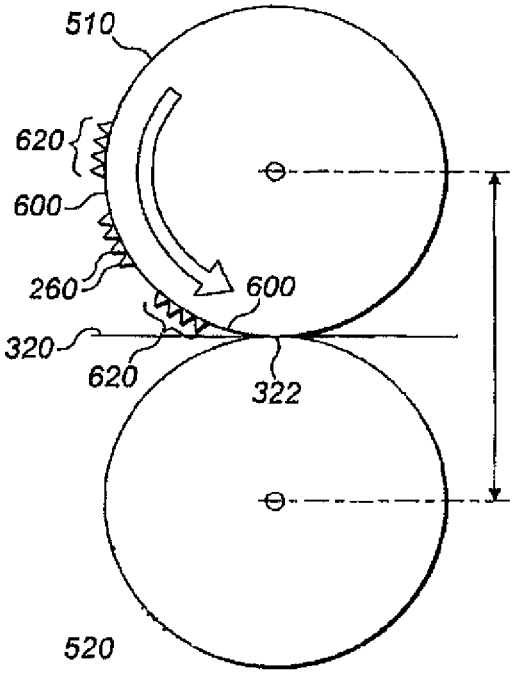
Figure 5B:
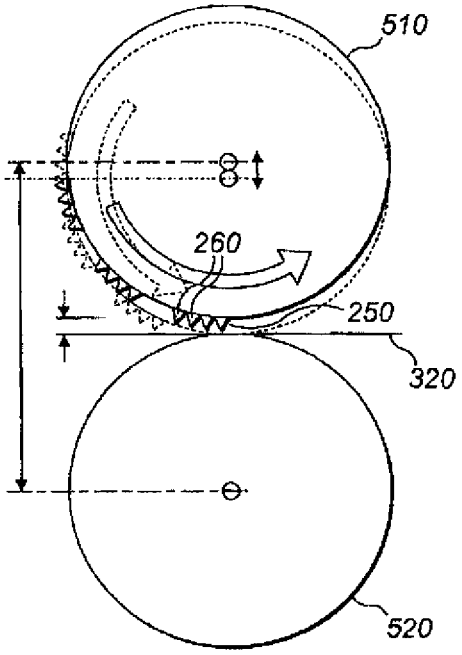
FIG. 5*b* is the front elevation of FIG. 5*a* showing an embossed region of the embossing drive roller in communication with the contrast roller.

As the wrapper is passed longitudinally through the embossing drive roller 510, a weakness is caused in the paper web 320 transversally at the start of each new embossed region. This is further explained with reference to FIGS. 5*a* and 5*b*, which shows an example arrangement for an embossing unit 500 having an embossing roller 510, and a single contrast roller 520, where the paper web 320 runs between these two rollers. As shown in FIG. 5*a*, a non-embossed portion of paper 322 sits between both rollers, at a non-embossed region 600 of the embossing drive roller 510. In FIG. 5*b*, the rollers have rotated such that a leading edge/row 250 of the embossing protrusions 260, at an embossed region 620 of the embossing drive roller 510, is pressed against the paper web 320 to cause embossing of the paper web 320. The embossing drive roller 510 rotates around its axis, causing a portion of its circumferential surface, containing embossing protrusions 260, to press against a portion of the circumferential surface of the contrast roller 520, through the paper web 320. The embossing rollers 510, 520 continue to rotate such that when the embossing protrusions 260 are situated between the contrast roller and the embossing drive roller, as shown in FIG. 5*b*, the distance between the respective circumferential surfaces of the rollers 510, 520 expands in order to permit the additional height of the embossing protrusions 260 to pass between the rollers 510, 520.

The embossing rollers 510, 520 rotate at a sufficiently high number of revolutions per minute such that the embossing drive roller 510 pulses against the embossing contrast roller 520, or vice versa, as the portion of the circumferential surface of the embossing roller which contacts the paper web changes from an embossed region 620 to a non-embossed region 600. This pulsing movement causes inertia as the circumferential surface of the embossing drive roller 510 moves closer and further away from circumferential surface of the contrast roller(s). This pulsing movement and inertia cause an increase in pressure on the paper web 320 as the leading edge 250 of the embossed region 620 is pressed against the paper web 320, and this results in a deeper embossing indentation. As described above, this introduces a significant weakness line 240 in the paper web 320, which can cause tearing of the paper web 320 during the cigarette manufacturing process. In addition, there is the further disadvantage of inconsistent embossing through the wrapper results in inconsistencies in the air permeability and diffusivity of the wrapper 320. The example arrangement in FIGS. 5*a* and 5*b* show the contrast roller 520 having no embossing pattern. However, the contrast roller(s) 520 may have thin longitudinal lines (not shown) of emboss pattern in order to assist drive to the paper web 320.

According to embodiments of the invention, the pressure applied to the moving web is controlled by limiting the movement of the embossing drive roller 510 as it moves toward and away from the contrast roller(s) 520 (or vice versa), in order to limit or prevent the pulsing movement described above. This may be achieved by limiting the movement of either the embossing drive roller 510 and/or the contrast rollers 520. This method stops the circumferential surfaces of the rollers 510, 520 from moving together in the non-embossed regions 600 of the embossing pattern which could occur as shown in FIG. 5*a*. In one embodiment, this method may employ the use of one or more cam stops or screw stops, also referred to as a cammed movement limiter. The embossing drive roller 510 is accordingly maintained at a predetermined distance from the paper web 320 so as to limit the depth of the embossing applied to the paper web 320.

Figure 6A:
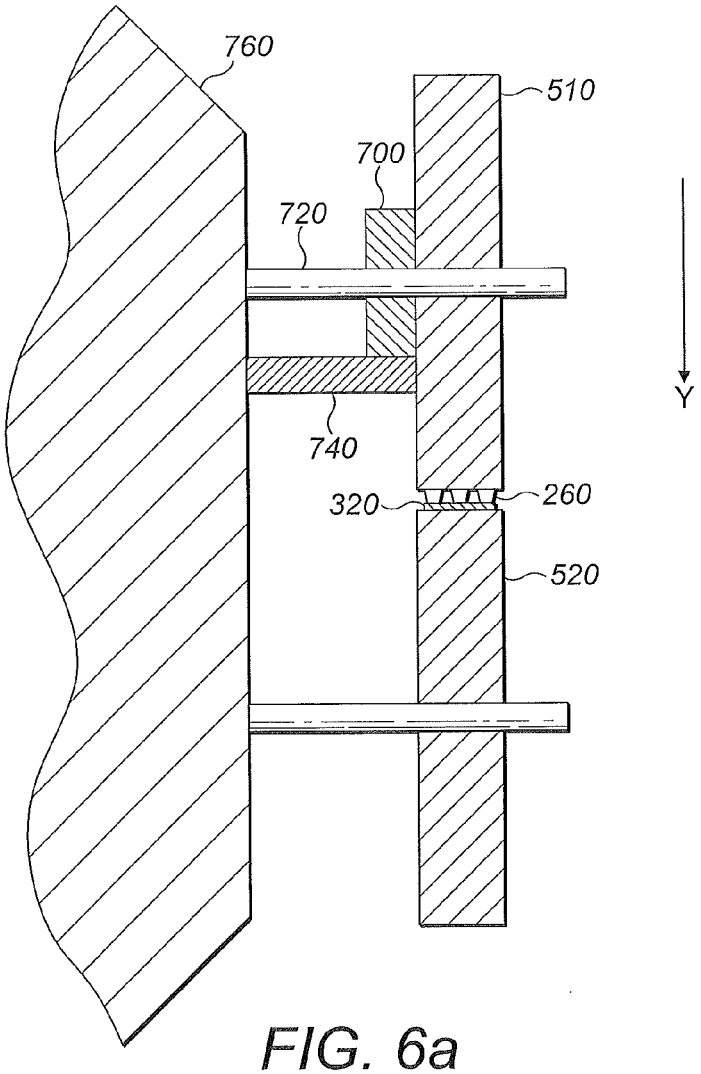
FIG. 6*a* is a side elevation of an embossing drive roller, of one embodiment of the present invention, having a cammed movement limiter for maintaining a minimum distance between the drive roller and contrast roller.
Figure 6B:
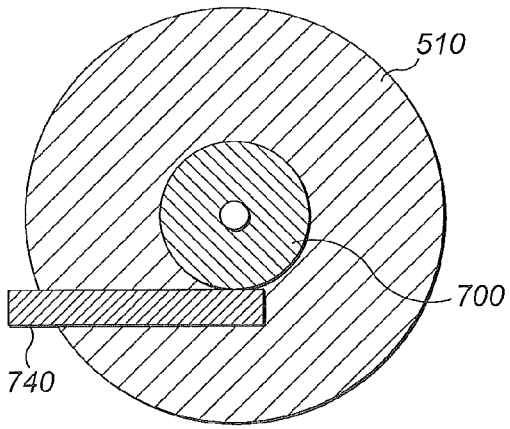
FIG. 6*b* a front elevation of the embossing drive roller of FIG. 6*a;*

An example configuration of a suitable cammed movement limiter is shown in FIGS. 6*a* and 6*b*. FIG. 6*a* shows a side elevation of an embossing drive roller 510 situated above at least one contrast roller 520, with a paper web 320 running between the rollers 510, 520. FIG. 6*b* shows a front elevation of the embossing drive roller 510. In one embodiment, the embossing drive roller 510 has a co-axial cammed movement limiter 700, formed integrally with the embossing drive roller 510 or fixed by any suitable means to the embossing drive roller 510. The embossing drive roller 510 is mounted to a roller drive unit 720 (partially shown in FIG. 6*a*), which delivers the rotational drive for the embossing drive roller. The cammed movement limiter 700 is arranged to butt against a stop 740, which is fixed to the roller drive unit or a housing 760 of the embossing drive roller 510. The embossing drive roller 510 is prevented from moving in direction Y, beyond a predetermined minimum distance from the contrast rollers 520, by the cammed movement limiter 700 abutting the stop 740. This means that the non-embossed regions 600 of the circumferential surface of the embossing drive roller 510 are prevented from moving closer than the predetermined minimum distance from the contrast rollers 520, alleviating the problem of the increase in pressure on the paper web 320 at the leading edge 250 of the embossed region 620.

In addition or alternatively, another solution to the above problem of reduced tensile strength is to determine an embossing pattern which minimises the stress under which the paper web is placed. In one embodiment this is achieved by disrupting or altering the leading edge/row of the embossed pattern on the embossing drive roller 510. In this sense, disrupting or altering the leading edge means changing the embossed region 620 from having a substantially perpendicular row of embossing protrusions 260 (as shown in FIG. 2) to any other suitable configuration.

Figure 7:
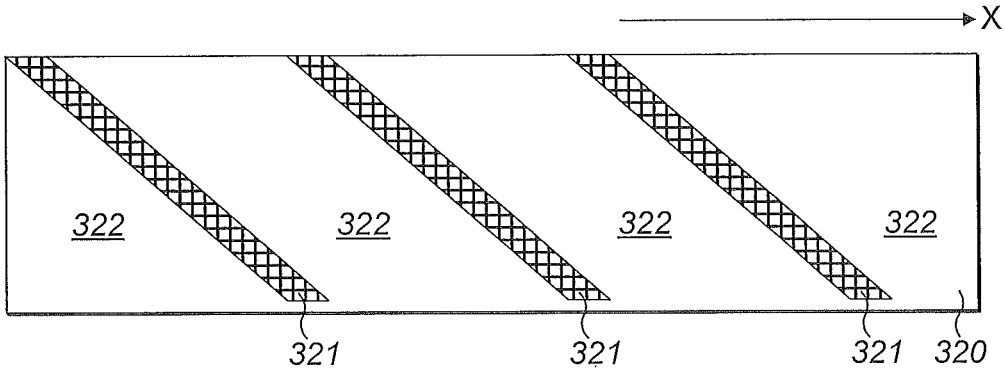
FIG. 7 is an illustration of a wrapper having an embossed region which is arranged in a spiral formation when wrapped around a smoking article.

In one example, the embossing drive roller 510 has embossing protrusions 260 in a spiral or helical pattern. An embossing drive roller 510 with such a spiral or helical pattern would result in a cigarette wrapper 320, as shown in FIG. 7. When such a cigarette wrapper 320 is wrapped around a smokable material rod, a band of embossing 321 is formed in the wrapper 320 which spirals around the circumference of the smokable material rod 300. The spiral band 321 may extend along all or part of the length of the rod 300. Selection of the length and width of the spiral band 321 may be made in dependence of the total length of the rod 300 and the properties of the wrapper 320 and smokable material 310. This configuration means that there is no laterally or perpendicularly extending leading edge to the embossing 321, and therefore the increase in pressure on the paper web 320 as the leading edge 250 of the embossed region 620 can be avoided. The configuration of the embossed region 321 of the wrapper 320 also means that when the cigarette rests against a surface, for example if a cigarette is dropped, a portion of the embossed region 321 of the wrapper 320 will rest against the surface. This limits the airflow through those blocked portions, which further reduces the air permeability of the cigarette wrapper 320 and further encourages the cigarette to self-extinguish.

A person skilled in the art will appreciate other formations for embossing protrusions 260 which may help mitigate the problems of reduced tensile strength of the paper web 320. For example, any pattern which interrupts the leading edge 250 may provide improvements in relation to tensile strength. In particular, staggering the leading edge 250 of the embossing protrusions 260 can give the desired result.

In addition or alternatively, the formation of embossing protrusions may also be altered to minimise the strain exerted on the paper web 320 during the embossing process. As an alternative to the embossing formation shown in FIG. 2, embossing formations similar to FIGS. 8*a* and 8*b* may be used.

Figure 8A:
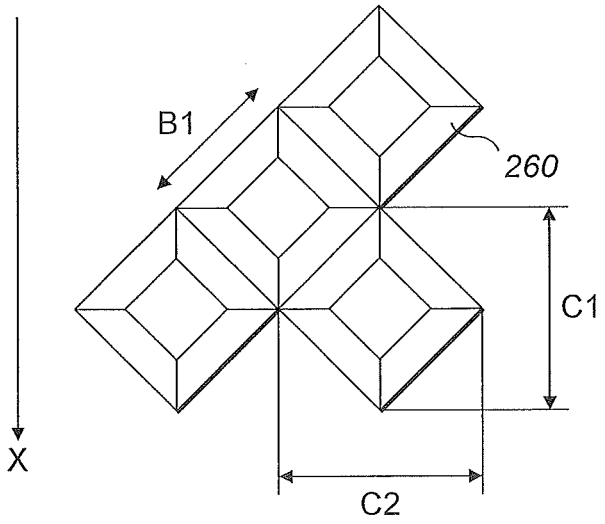
FIGS. 8*a* and 8*b* are example embossing patterns according to embodiments of the present invention.

In one embodiment, the embossing formation is a rhomboid pattern shown in FIG. 8*a*. Configuring dimension 'C1' to be equal to or greater than dimension 'B1' used in the embossing pattern of FIG. 2, having the same number, size and distribution of embossing protrusions, has the effect of reducing the strain on the paper web in the longitudinal dimension, when compared to the embossing pattern of FIG. 2. The reason that the strain on the paper web is reduced in this direction is that the protrusion is effective over a greater distance of paper web in this direction, and therefore strain (defined as the extension of the paper web divided by its original length) and/or stress (the force applied to the paper per unit area) is reduced in this direction.

Figure 8B:
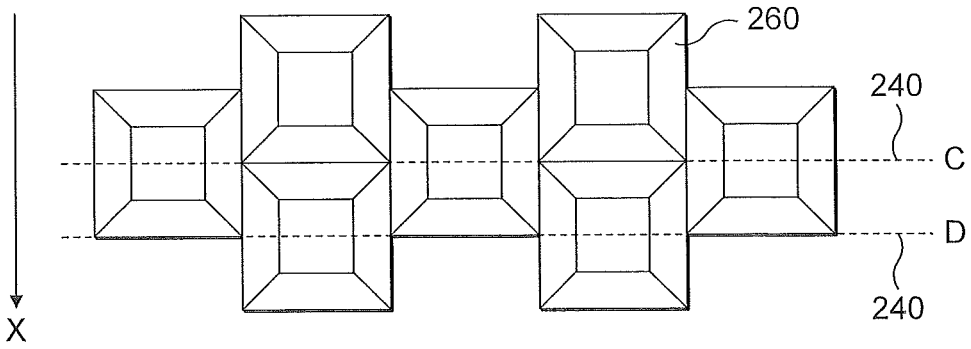

In another embodiment, adjacent embossing protrusions 260 are offset from each other in the longitudinal direction A, as shown in FIG. 8*b*. This pattern reduces the longitudinal weakness at lines 'C' and 'D' because the weakness lines 240 run through fewer indentations in the paper web 320.

In addition, or as an alternative, to changing the embossed pattern and/or formation, it is possible to minimise the depth of the embossing in order to improve the tensile strength of the paper, without reducing the desired effects on the permeability or diffusivity of the wrapper 320. As described above, the air permeability and gas diffusivity of the embossed region 321 of the paper 320 can be selected by varying the size and number of the embossing protrusions 260 as well as varying the coverage area of the embossing protrusions 260. In order to minimise the depth of the embossing to improve the tensile strength of the paper, the embossing drive roller 510 is provided with a higher number of protrusions of a smaller dimension than those shown and discussed in relation to FIG. 2. The applied pressure is spread over a greater surface area, meaning that the depth of embossing is reduced. By reducing the depth of embossing the stress/strain on the paper web 320 is reduced, such that the above problem of reduced tensile weakness may be avoided or diminished. For instance, the protrusions can have a base width of less than 0.3 mm, for instance approximately 0.2 mm, 0.1 mm or less, and a height of less than 0.15 mm, for instance approximately 0.1, 0.09, 0.08 mm, 0.07 mm, 0.06 mm or less.

Figure 9:
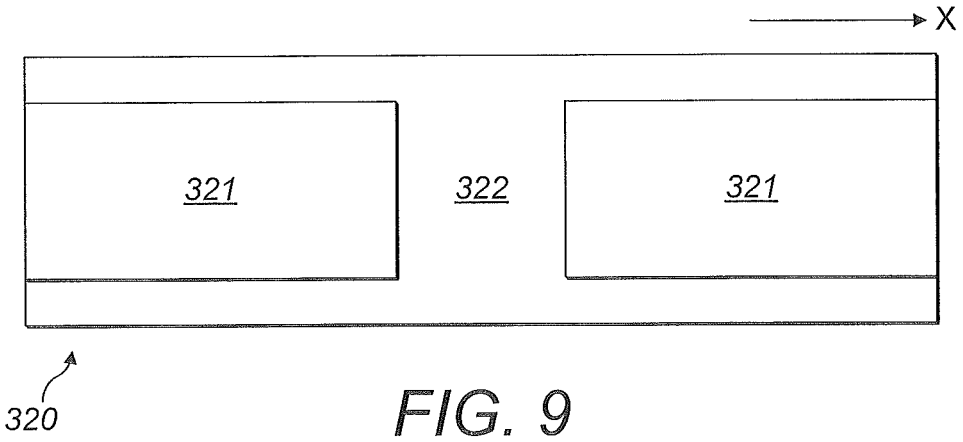
FIG. 9 is an illustration of a wrapper showing longitudinal non-embossed strips.

In addition, or as an alternative to the above solutions, a further method for preventing or diminishing the problem of reduced tensile strength may be achieved by having non-embossed strips which run longitudinally along the length of the wrapper, as shown in FIG. 9. By not embossing the paper web 320 transversally across the whole width of the paper web, disrupts the weakness lines 240 shown in FIG. 9. This improves the tensile strength of the paper web in comparison to an embossed paper web which does not have longitudinal non-embossed strips.

A person skilled in the art will appreciate that the above solutions any be utilised in any combination to produce desired results.

Although the invention has been described above in relation to a cigarette paper, the invention is also applicable to other smoking article wrapping materials, such as tipping paper, plug wrap and cigar papers, as would be appreciated by those skilled in the art.

The invention claimed is:

1. An embossing apparatus comprising an embosser roller configured to apply an embossed pattern to a smoking article wrapper, the embossed pattern including:

an embossed band having a plurality of embossments;

a non-embossed region; and a leading edge between the embossed band and the non-embossed region, the leading edge being continuously non-perpendicular to a longitudinal direction of the wrapper so as to at least partially offset a reduction, in at least one direction, in a tensile strength of the wrapper resulting from application of the embossed pattern.

2. The embossing apparatus as claimed in claim 1, wherein the embossed pattern is configured to increase at least one of diffusivity or permeability of the wrapper, and wherein the embossed pattern is selected such that for a given increase in at least one of diffusivity or permeability, the embossed pattern reduces at least one of embossing stress or strain placed on the wrapper during application of the embossed pattern, in at least one direction.

3. The embossing apparatus as claimed in claim 2, wherein application of the embossed pattern is arranged to result in an embossed wrapper having different strength characteristics in different directions.

4. The embossing apparatus as claimed in claim 1, further comprising:

a movement limiter configured to maintain the embosser roller at a predetermined distance from said wrapper, thereby limiting the depth of the embossed pattern.

5. The embossing apparatus as claimed in claim 4, further comprising:

at least one additional embosser roller configured to emboss the wrapper running in a longitudinal direction between the embossing rollers, the movement limiter being configured to maintain a minimum distance between circumferential surfaces of the embosser rollers.

6. An embossed wrapper for a smoking article, comprising wrapper material, the wrapper defining an embossed pattern including:

an embossed band having a plurality of embossments;

a non-embossed region; and a leading edge between the embossed band and the non-embossed region, the leading edge being non-perpendicular to a longitudinal direction of the wrapper so that, for a given increase in at least one of diffusivity or permeability resulting from the embossed pattern, the embossed pattern is configured to at least partially offset a reduction, in at least one direction, in a tensile strength of the wrapper resulting from application of the embossed pattern.

7. The embossed wrapper as claimed in claim 6, wherein the embossed pattern is selected to reduce weakness lines running through the embossed band of the wrapper, in at least one direction.

8. The embossed wrapper as claimed in claim 6, wherein the embossed band comprises one of a spiral pattern or a helical pattern when the wrapper is wrapped around the smoking article.

9. The embossed wrapper as claimed in claim 6, wherein the embossed band of the wrapper comprises indentations which have no substantially perpendicular edges with respect to the longitudinal direction of the wrapper.

10. The embossed wrapper as claimed in claim 6, wherein the embossed band of the wrapper comprises indentations of rhomboidal shape which have no substantially perpendicular edges with respect to the longitudinal direction of the wrapper.

11. The embossed wrapper as claimed in claim 6, wherein the embossed band is formed from an array of indentations in which transversally adjacent indentations are longitudinally offset from each other.

12. An embosser roller for applying an embossed pattern to a wrapper for a smoking article, the embosser roller comprising;

an embossing region including an embossing band having a plurality of embossing protrusions;

a non-embossing region; and a leading edge between the embossing region and the non-embossing region, the leading edge being continuously non-perpendicular to a longitudinal direction of the wrapper such that, in use, for a given increase in at least one of diffusivity and permeability of a wrapper embossed using the embosser roller, the plurality of embossing protrusions act to at least partially offset a reduction, in at least one direction, in a tensile strength of the wrapper resulting from the application of said embossed pattern.

13. A method of embossing a wrapper for a smoking article, the method comprising:

applying an embossed pattern to the wrapper, the embossed pattern including an embossed band having a plurality of embossments, a non-embossed region, and a leading edge between the embossed band and the non-embossed region, the leading edge being substantially non-perpendicular to a longitudinal direction of the wrapper so as to at least partially offset a reduction, in at least one direction, in a tensile strength of the wrapper resulting from the application of the embossed pattern.

14. The method of claim 13, wherein applying the embossed pattern to the wrapper further comprises:

applying an embosser roller to the wrapper; and maintaining the embosser at a predetermined distance from the wrapper so as to limit a depth of the embossed pattern.

15. The method of claim 14, wherein the applying further comprises:

running a web of wrapper material, in a longitudinal direction, through at least two embosser rollers, and the maintaining comprises:

using a coaxial cammed movement limiter and a mechanical stop to prevent radial movement of at least one of the embosser rollers in at least one direction.

16. A smoking article comprising:

a rod of smokeable material; and an embossed wrapper for a smoking article, the embossed wrapper comprising (1) an embossed pattern including an embossed band having a plurality of embossments, (2) a non-embossed region, and (3) a leading edge between the embossed band and the non-embossed region, the leading edge being substantially non-perpendicular to a longitudinal direction of the wrapper so that, for a given increase in at least one of diffusivity or permeability resulting from the embossed pattern, the embossed pattern is configured to at least partially offset a reduction, in at least one direction, in a tensile strength of the wrapper resulting from application of the embossed pattern.

17. A method comprising:

running a web of wrapper material, in a longitudinal direction, through at least two embosser rollers to produce a wrapper for a smoking article;

applying an embossed pattern to the wrapper by applying the embosser rollers to the wrapper such that a reduction, in at least one direction, in a tensile strength of the wrapper resulting from application of the embossed pattern is at least partially offset;

maintaining at least one of the embosser rollers at a predetermined distance from the wrapper so as to limit a depth of the embossed pattern using a coaxial cammed movement limiter; and preventing radial movement of at least one of the rollers in at least one direction using a mechanical stop.

18. An embossing apparatus for applying embossing to a wrapper for a smoking article, the embossing apparatus comprising:

at least two embosser rollers configured to receive a web of wrapper material running therebetween in a longitudinal direction and to apply an embossed pattern to the web of wrapper material such that a reduction, in at least one direction, in a tensile strength of the wrapper resulting from application of the embossed pattern is at least partially offset;

a coaxial cammed movement limiter configured to maintain at least one of the embosser rollers at a predetermined distance from the wrapper so as to limit the depth of the embossed pattern; and a mechanical stop configured to prevent radial movement of at least one of the embosser rollers in at least one direction.

* * * * *

UNITED STATES PATENT AND TRADEMARK OFFICE

CERTIFICATE OF CORRECTION

PATENT NO. : 8,973,589 B2
APPLICATION NO. : 13/642441
DATED : March 10, 2015
INVENTOR(S) : Karl Kaljura and Leonardo Nappi It is certified that error appears in the above-identified patent and that said Letters Patent is hereby corrected as shown below:

In the Drawings

Delete drawing sheet 3 or 6, and replace with drawing sheet 3 of 6. (Attached)

Signed and Sealed this
Seventh Day of July, 2015

Michelle K. Lee

Michelle K. Lee
*Director of the United States Patent and Trademark Office*